US011434119B2

(12) United States Patent
Tracy

(10) Patent No.: US 11,434,119 B2
(45) Date of Patent: Sep. 6, 2022

(54) SYSTEMS AND METHODS FOR EFFICIENT HYDRAULIC PUMP OPERATION IN A HYDRAULIC SYSTEM

(71) Applicant: THE RAYMOND CORPORATION, Greene, NY (US)

(72) Inventor: Erik C. Tracy, Johnson City, NY (US)

(73) Assignee: The Raymond Corporation, Greene, NY (US)

( * ) Notice: Subject to any disclaimer, the term of this patent is extended or adjusted under 35 U.S.C. 154(b) by 714 days.

(21) Appl. No.: 16/377,641

(22) Filed: Apr. 8, 2019

(65) Prior Publication Data

US 2019/0308857 A1 Oct. 10, 2019

Related U.S. Application Data

(60) Provisional application No. 62/653,850, filed on Apr. 6, 2018.

(51) Int. Cl.

| | |
|---|---|
| ***B66F 9/075*** | (2006.01) |
| ***B66F 9/07*** | (2006.01) |
| ***B66F 9/22*** | (2006.01) |

(52) U.S. Cl.
CPC ..... *B66F 9/0755* (2013.01); *B66F 9/072* (2013.01); *B66F 9/22* (2013.01)

(58) Field of Classification Search
CPC ..... B66F 9/22; B66F 9/072; B66F 9/0755
See application file for complete search history.

(56) References Cited

U.S. PATENT DOCUMENTS

| | | | |
|---|---|---|---|
| 2,737,824 | A | 3/1956 | Livermore |
| 3,001,415 | A | 9/1961 | Smirl |
| 3,570,056 | A | 3/1971 | Hall et al. |

(Continued)

FOREIGN PATENT DOCUMENTS

| | | | |
|---|---|---|---|
| CN | 105347266 | A | 2/2016 |
| EP | 1953114 | A2 | 8/2008 |

(Continued)

OTHER PUBLICATIONS

European Patent Office, Extended European Search Report, Application No. 19167990.1, dated Sep. 10, 2019, 7 pages.

(Continued)

*Primary Examiner* — Thomas D Alunkal
(74) *Attorney, Agent, or Firm* — Quarles & Brady LLP

(57) ABSTRACT

The present disclosure provides systems and methods for determining an efficient hydraulic pump speed of a hydraulic pump configured for use with a hydraulic system of a material handling vehicle having a fork assembly configured to perform a hydraulic function on a load on the fork assembly. In some configurations, the systems and methods may comprise measuring a height of the fork assembly using a height sensor. The systems and methods may further comprise measuring a temperature of hydraulic oil within the hydraulic system using a temperature sensor. The systems and methods may further comprise measuring a weight of the load using a weight sensor. The systems and methods may further comprise determining a hydraulic pump speed based on at least one of the height of the fork assembly, the temperature of the hydraulic oil, and the weight of the load.

20 Claims, 12 Drawing Sheets

(56) References Cited

U.S. PATENT DOCUMENTS 3,706,825 A 12/1972 Hall et al.
4,426,194 A 1/1984 Pollman
5,170,021 A * 12/1992 Martini ..... B66B 1/24 187/286
5,285,642 A 2/1994 Watanabe et al.
5,341,695 A * 8/1994 Avitan ..... B66F 9/0755 73/1.81
5,470,458 A 11/1995 Ripley et al.
5,921,846 A 7/1999 Katz
6,167,965 B1 1/2001 Bearden et al.
6,210,030 B1 4/2001 Ibar
6,216,456 B1 4/2001 Mitchell
6,219,601 B1 * 4/2001 Shono ..... B60G 17/018 701/37
6,267,042 B1 * 7/2001 Nagai ..... F15B 15/2884 414/273
6,321,860 B1 11/2001 Reddoch
6,330,525 B1 * 12/2001 Hays ..... F04D 15/0088 702/182
7,059,282 B2 6/2006 Vorih et al.
7,410,250 B2 8/2008 Silverbrook
7,584,611 B2 * 9/2009 Ariga ..... E02F 9/2235 60/431
8,136,355 B2 * 3/2012 Yasuda ..... F04C 14/065 60/449
8,476,205 B2 7/2013 Lee et al.
8,924,103 B2 * 12/2014 Dammeyer ..... B66F 17/003 414/664
2001/0023671 A1 9/2001 Vorih
2003/0098000 A1 5/2003 Vorih et al.
2005/0024436 A1 2/2005 Silverbrook
2005/0052514 A1 3/2005 Silverbrook
2006/0191732 A1 8/2006 Lunzman et al.
2006/0207247 A1 9/2006 Nagai et al.
2007/0291091 A9 12/2007 Silverbrook
2008/0095652 A1 4/2008 Jiang
2009/0062427 A1 3/2009 Tornow et al.
2011/0092726 A1 4/2011 Clarke
2011/0197833 A1 8/2011 Vorih et al.
2014/0311449 A1 10/2014 Vorih et al.
2015/0072400 A1 3/2015 Clarke
2015/0123303 A1 5/2015 Tornow et al.
2016/0082405 A1 * 3/2016 Fomitchev-Zamilov ..... B01J 19/008 251/304
2016/0222841 A1 8/2016 Vorih et al.
2017/0002731 A1 1/2017 Wei
2017/0036967 A1 2/2017 Sevast'Yanov et al.
2017/0204707 A1 7/2017 Clark et al.
2019/0063474 A1 * 2/2019 Brinkman ..... G06G 5/00

FOREIGN PATENT DOCUMENTS

EP 2123594 A1 11/2009
JP 2010255780 A 11/2010
WO 2011000473 A2 1/2011

OTHER PUBLICATIONS

"Automatic Stacker Design" (textbook), p. 26, published Dec. 31, 1979, 2 pages [Category A Non-Patent Document cited in China National Intellectual Property Administration Second Office Action, Application No. 201910277010.2, May 19, 2022, no English language translation provided].

* cited by examiner

SYSTEMS AND METHODS FOR EFFICIENT HYDRAULIC PUMP OPERATION IN A HYDRAULIC SYSTEM

CROSS-REFERENCES TO RELATED APPLICATIONS

The present application is based on, claims priority to, and incorporates herein by reference in its entirety U.S. Provisional Patent Application No. 62/653,850, filed on Apr. 6, 2018, and entitled "Systems and Methods for Efficient Hydraulic Pump Operation in a Hydraulic System."

STATEMENT REGARDING FEDERALLY SPONSORED RESEARCH

Not Applicable.

BACKGROUND

Conventional hydraulic lift systems for material handling vehicles are typically sized and/or operated according to maximum requirement operating conditions. These maximum requirement operating conditions may require hydraulic component sizing that exceeds necessary sizing for standard use or operation of the hydraulic system at a slower speed than possible for a given set of operating conditions. Thus, sizing and/or operating hydraulic lift systems according to maximum requirement operating conditions may among other things reduce potential speed and efficiency of the hydraulic lift system.

BRIEF SUMMARY

The present disclosure relates generally to hydraulic systems and, more specifically, to a hydraulic lift systems and methods for a material handling vehicle.

In one aspect, the present disclosure provides systems and methods for determining an efficient hydraulic pump speed of a hydraulic pump configured for use with a hydraulic system of a material handling vehicle having a fork assembly configured to perform a hydraulic function on a load on the fork assembly. In some configurations, the systems and methods may comprise measuring a height of the fork assembly using a height sensor. The systems and methods may further comprise measuring a temperature of hydraulic oil within the hydraulic system using a temperature sensor. The systems and methods may further comprise measuring a weight of the load using a weight sensor. The systems and methods may further comprise determining a hydraulic pump speed based on at least one of the height of the fork assembly, the temperature of the hydraulic oil, and the weight of the load.

In one aspect, the present disclosure provides a method for controlling pump speed in a hydraulic system on a material handling vehicle. The method includes measuring a temperature, via a temperature sensor, of hydraulic fluid during operation of the material handling vehicle, measuring a height, via a height sensor, of a fork assembly on the material handling, determining a target pump speed based on the measured temperature of the hydraulic fluid and the measured height of the fork assembly, and controlling a pump speed of a hydraulic pump on the material handling vehicle to operate within a predefined tolerance of the target pump speed.

In one aspect, the present disclosure provides material handling vehicle that includes a fork assembly and a hydraulic system. The hydraulic system includes a hydraulic pump configured furnish hydraulic fluid to the fork assembly to selectively operate the fork assembly with the hydraulic system, a temperature sensor configured to measure a temperature of the hydraulic fluid within the hydraulic system, and a height sensor configured to measure a height of the fork assembly. The material handling vehicle further includes a controller in communication with the temperature sensor and the height sensor. The controller being configured to receive a temperature value from the temperature sensor, receive a height value from the height sensor, determine a target pump speed based on the temperature value and the height value, and control the hydraulic pump to operate within a predefined tolerance of the target pump speed.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
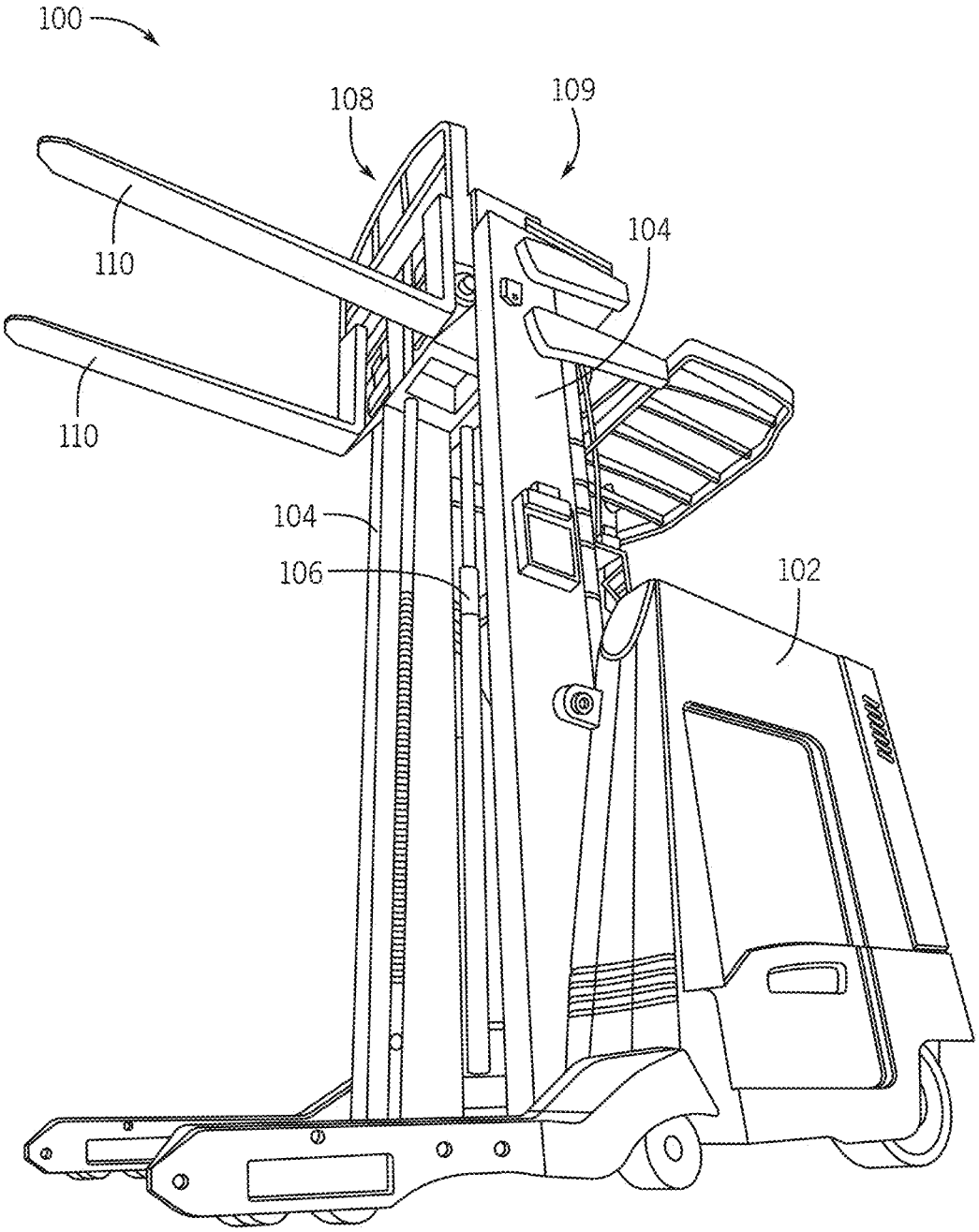
FIG. 1 is a pictorial view of a material handling vehicle in accordance with aspects of the present disclosure.

Before any aspects of the invention are explained in detail, it is to be understood that the invention is not limited in its application to the details of construction and the arrangement of components set forth in the following description or illustrated in the following drawings. The invention is capable of other aspects and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

It is also to be appreciated that material handling vehicles (MHVs) are designed in a variety of configurations to perform a variety of tasks. Although the MHV described herein is shown by way of example as a reach truck, it will be apparent to those of skill in the art that the present invention is not limited to vehicles of this type, and can also be provided in various other types of MHV configurations, including for example, orderpickers, swing reach vehicles, and any other lift vehicles. The various systems and methods disclosed herein are suitable for any of driver controlled, pedestrian controlled, remotely controlled, and autonomously controlled material handling vehicles.

FIG. 1 illustrates one non-limiting example of a material handling vehicle (MHV) 100 in the form of a reach truck according to one non-limiting example of the present disclosure. The MHV 100 can include a base 102, a telescoping mast 104, one or more hydraulic actuators 106, a fork assembly 108, and a reach mechanism 109. The hydraulic actuators 106 can be coupled to the telescoping mast 104 and may be configured to selectively extend or retract the telescoping mast 104. The fork assembly 108 can be coupled to the telescoping mast 104 so that when the telescoping mast 104 is extended or retracted, the fork assembly 108 can also be raised or lowered therewith. The fork assembly 108 can further include one or more forks 110 on which various loads (not shown) can be manipulated or carried by the MHV 100. The reach mechanism 109 may be configured to extend or retract the fork assembly 108 away from or toward the telescoping mast 104.

Figure 2:
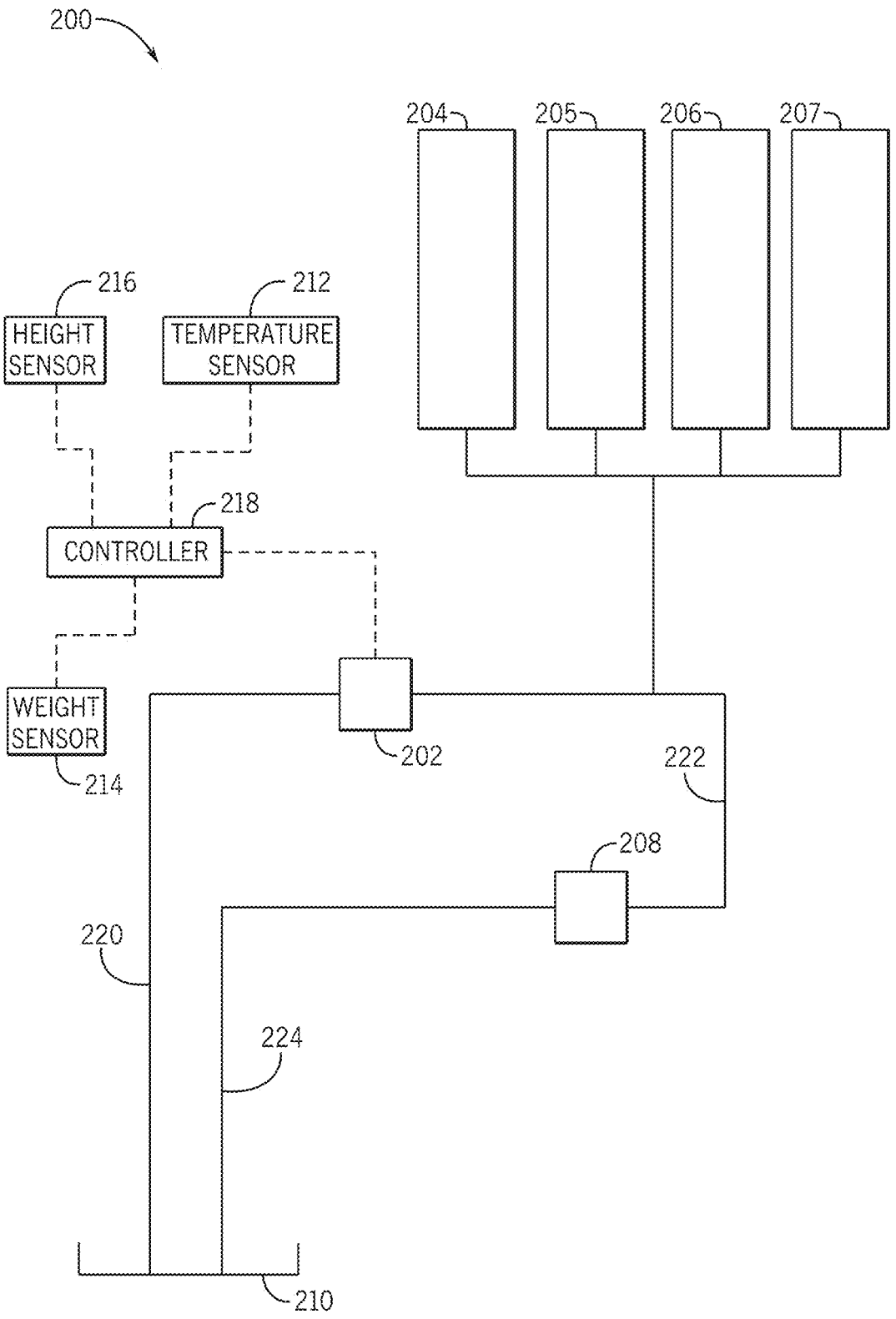
FIG. 2 is a schematic illustration of an exemplary hydraulic system according to aspects of the present disclosure.

FIG. 2 illustrates one non-limiting example of a regenerative or non-regenerative lift/lowering hydraulic system 200 which may be present on the MHV 100 to control operation of the hydraulic actuator 109 and/or the reach mechanism 109 (among other components). As will be described herein, the hydraulic system 200 may be configured to control and optimize pump/motor performance capabilities, maximize pump/component life, and improve energy efficiency by monitoring hydraulic oil temperature to approximate oil viscosity, payload on the forks, and elevated height.

The hydraulic system 200 may include, but is not limited to, a hydraulic pump 202, a main lift cylinder 204, a free lift cylinder 205, a first auxiliary cylinder 206, a second auxiliary cylinder 207, a flow restriction device 208, a reservoir tank 210, a temperature sensor 212, a weight sensor 214, a height sensor 216, and a controller 218 with at least one memory and at least one processor. The hydraulic pump 202 may be configured to draw fluid, for example, hydraulic oil or any other suitable hydraulic fluid, from the reservoir tank 210, through a supply line 220 and furnish the fluid at a higher pressure at a pump outlet. The high pressure of the fluid may be maintained downstream of the hydraulic pump 202, within a pressurized line 222, through the use of the flow restriction device 208, which may comprise a variable flow orifice or any other suitable flow restriction device. In some instances, the pressurized line 222 may include any variety of additional selective flow devices (not shown), for example, a hydraulic manifold having a plurality of control valves, a plurality of relief valves, or any other suitable selective flow devices for a given application. As such, the hydraulic system 200 may be configured to selectively apply the high pressure fluid to any of the main lift cylinder 204, the free lift cylinder 205, the first auxiliary cylinder 206, or the second auxiliary cylinder 207.

In some instances, the main lift cylinder 204 may be configured to actuate the at least one hydraulic actuator 106 of the MHV 100 to selectively extend or retract the telescoping mast 104. In some instances, the free lift cylinder 205 may be coupled to the fork assembly 108, between the fork assembly 108 and the telescoping mast 104, and may be configured to selectively raise and lower the fork assembly 108 with respect to telescoping mast 104. In some instances, the first auxiliary cylinder 206 and the second auxiliary cylinder 207 may be configured to perform various auxiliary hydraulic functions on the MHV 100. For example, the first auxiliary cylinder 206 and the second auxiliary cylinder 207 may be configured to actuate the reach mechanism 109 to reach or retract the fork assembly 108 away from the telescoping mast 104. In other non-limiting examples, the first auxiliary cylinder 206 and the second auxiliary cylinder 207 may be configured to perform other auxiliary hydraulic functions (e.g., tilting the telescoping mast 104). In some instances, there may be more or less than two auxiliary cylinders 206, 207 in the hydraulic system 200.

In some aspects, the controller 218 may monitor a temperature of the hydraulic oil within the hydraulic system 200 using the temperature sensor 212. The temperature sensor 212 may comprise hydraulic system thermocouple(s) or any other suitable temperature sensor 212. The temperature sensors 212 may further be located in the tank, tank and return sides of hydraulic cylinders, fittings, or any other suitable locations. The temperature of the hydraulic oil may be used to approximate the viscosity of the oil in the hydraulic system 200 of the MHV 100. The approximated viscosity may be used to estimate pump inlet pressure based on the pressure drop in the hydraulic system 200 due to the viscosity of the oil. The controller 218 may be configured to control and/or optimize performance of the MHV 100 based on the temperature of the oil.

In some aspects, the controller 218 may additionally or alternatively monitor a payload on the fork assembly 108 using the weight sensor 214. The weight sensor 214 may comprise one or more inline pressure transducer(s), strain gages on the forks, or any other suitable weight sensor. The payload on the fork assembly 108 may be used to determine a system pressure at the pump inlet (while lowering the fork assembly 108) or outlet (while lifting the fork assembly 108) due to the payload. The controller 218 may be configured to control and/or optimize performance of the MHV 100 based on the pressure in the hydraulic system 200 due to payload.

In some aspects, the controller 218 may additionally or alternatively monitor an elevated height of the fork assembly 108 using one or more height sensors 216. From the elevated height of the fork assembly 108, an additional pressure value in the lift/lower system 200 can be determined. The additional pressure value can be due to the weight of the elevating mast sections of the telescoping mast 104 during a main lift operating state (i.e., when both the fork assembly 108 and sections of the telescoping mast 104 are being lifted) that are not present during a free lift operating state (i.e., when just the fork assembly 108 is being lifted). The controller 218 may be configured to control and/or optimize performance of the MHV 100 based on the additional pressure in the system at specified heights and/or the lift state.

Figure 3:
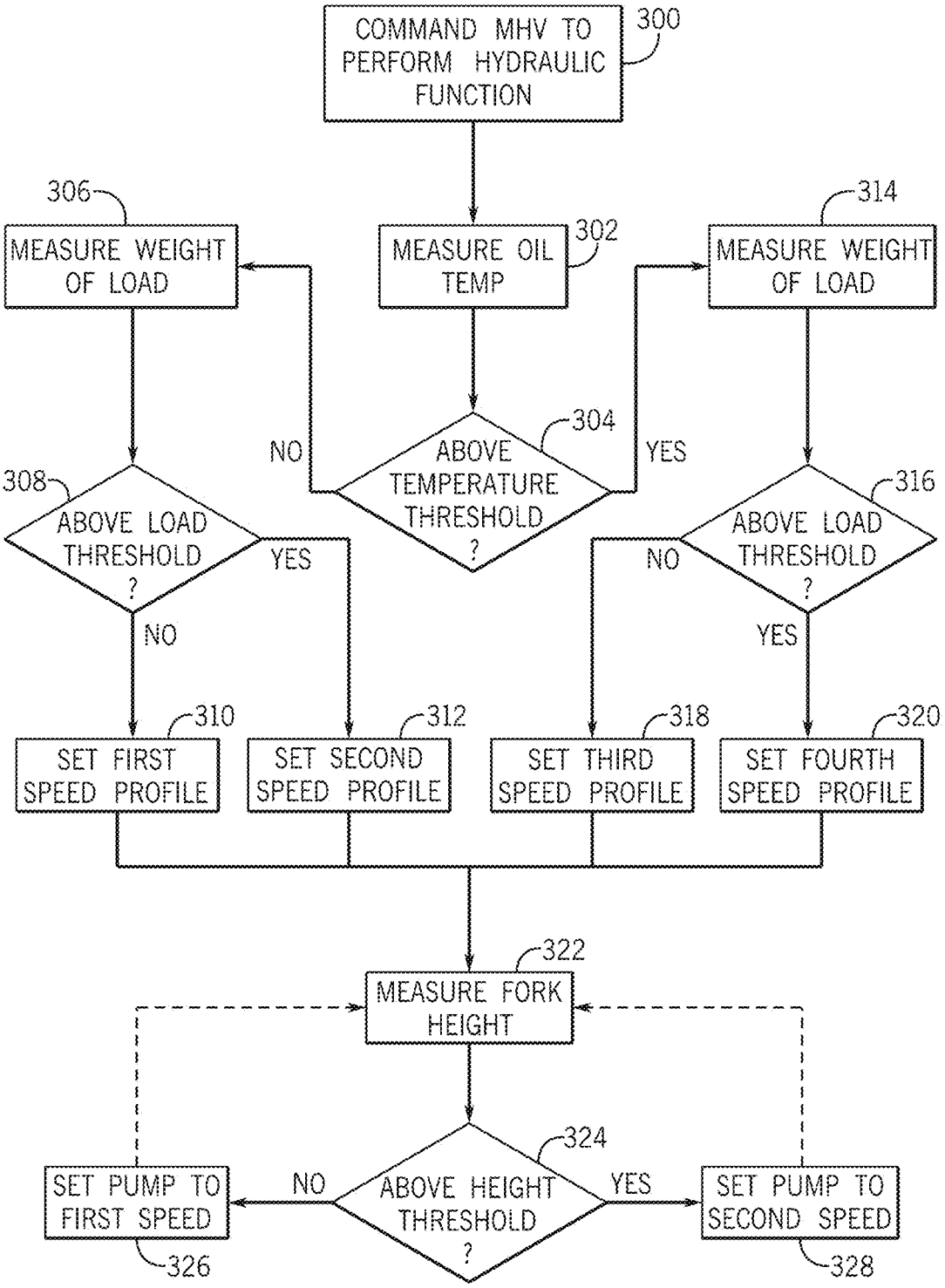
FIG. 3 is a flowchart showing a method of operating a hydraulic pump motor of the hydraulic system of FIG. 2.

FIG. 3 illustrates one non-limiting example of steps for setting a speed of the hydraulic pump 202 while using the hydraulic system 200 of FIG. 2. During operation, a user can command, at step 300, the MHV 100 to perform a hydraulic function, for example, raising, lowering, reaching, or retracting the fork assembly 108 or any other desired hydraulic function. Once the user commands the MHV 100 to perform the hydraulic function, the controller 218 can measure, at step 302, the temperature of the hydraulic oil within the hydraulic system 200 using the temperature sensor 212. After measuring the temperature of the hydraulic oil, at step 302, the controller 218 can then determine, at step 304, if the temperature of the hydraulic oil is above a predetermined temperature threshold. If the controller 218 determines, at step 304, that the temperature of the hydraulic oil is not above the predetermined temperature threshold, the controller 218 can then measure, at step 306, the weight of the payload on the fork assembly 108 using the weight sensor 214. After measuring the weight of the payload on the fork assembly 108, at step 306, the controller 218 can determine, at step 308, if the payload is above a predetermined weight threshold. If the controller 218 determines, at step 308, that the payload on the fork assembly 108 is not above the predetermined weight threshold, the controller 218 can set, at step 310, a first speed profile 402 (shown in FIG. 4). If the controller 218 determines, at step 308, that the payload on the fork assembly 108 is above the predetermined weight threshold, the controller 218 can set, at step 312, a second speed profile 404 (shown in FIG. 4).

If the controller determines, at step 304, that the temperature of the hydraulic oil is above the predetermined temperature threshold, the controller 218 can measure, at step 314, the weight of the payload on the fork assembly 108 using the weight sensor 214. After measuring the weight of the payload on the fork assembly 108, at step 314, the controller 218 can determine, at step 316, if the payload is above a predetermined weight threshold. If the controller determines, at step 316, that the payload on the fork assembly 108 is not above the predetermined weight threshold, the controller 218 can set, at step 318, a third speed profile 406 (shown in FIG. 4). If the controller determines, at step 316, that the payload on the fork assembly 108 is above the predetermined weight threshold, the controller 218 can set, at step 320, a fourth speed profile 408 (shown in FIG. 4).

After setting the first, second, third, or fourth speed profile, at step 310, 312, 318, or 320, the controller 218 can measure, at step 322, the height of the fork assembly 108 using the height sensor 216. After measuring the height of the fork assembly 108, at step 322, the controller 218 can determine, at step 324, if the fork assembly 108 is above a predetermined height threshold. If the controller 218 determines, at step 324, that the fork assembly 108 is not above the predetermined height threshold, the controller 218 can set, at step 326, the hydraulic pump 202 to run at a first speed of the corresponding speed profile. If the controller 218 determines, at step 324, that the fork assembly 108 is above the predetermined height threshold, the controller 218 can set, at step 328, the hydraulic pump 202 to run at a second speed of the corresponding speed profile.

The predetermined height threshold may correspond to a height where the MHV 100 switches from a free lift operating state (i.e., where the fork assembly 108 is being raised and lowered using the free lift cylinder 205), when the fork assembly 108 is below the predetermined height threshold, to a main lift operating state (i.e., where the fork assembly 108 is being raised and lowered using the main lift cylinder 204), when the fork assembly 108 is above the predetermined height threshold.

After the speed of the hydraulic pump 202 is set, at either step 326 or step 328, the controller 218 can return to measuring the height of the fork assembly 108, at step 322, such that the controller 218 may intermittently or continuously monitor the height of the fork assembly 108. With the controller intermittently or continuously monitoring the height of the fork assembly 108, if the fork assembly 108 drops below or rises above the predetermined height threshold, the controller 218 can switch the hydraulic pump 202 from the first speed to the second speed, or vice versa. It is to be appreciated that there may be several different height ranges and several different associated speed settings.

In some embodiments, the controller may only use the temperature of the hydraulic oil and the height of the fork assembly 108 in order to determine a target pump speed. The controller may execute steps 300, 302, and 304, set a speed profile based on comparing the temperature of the hydraulic oil to the temperature threshold after executing step 304, and then proceed to steps 322, 324, 326 and/or 328 as described above.

Figure 4:
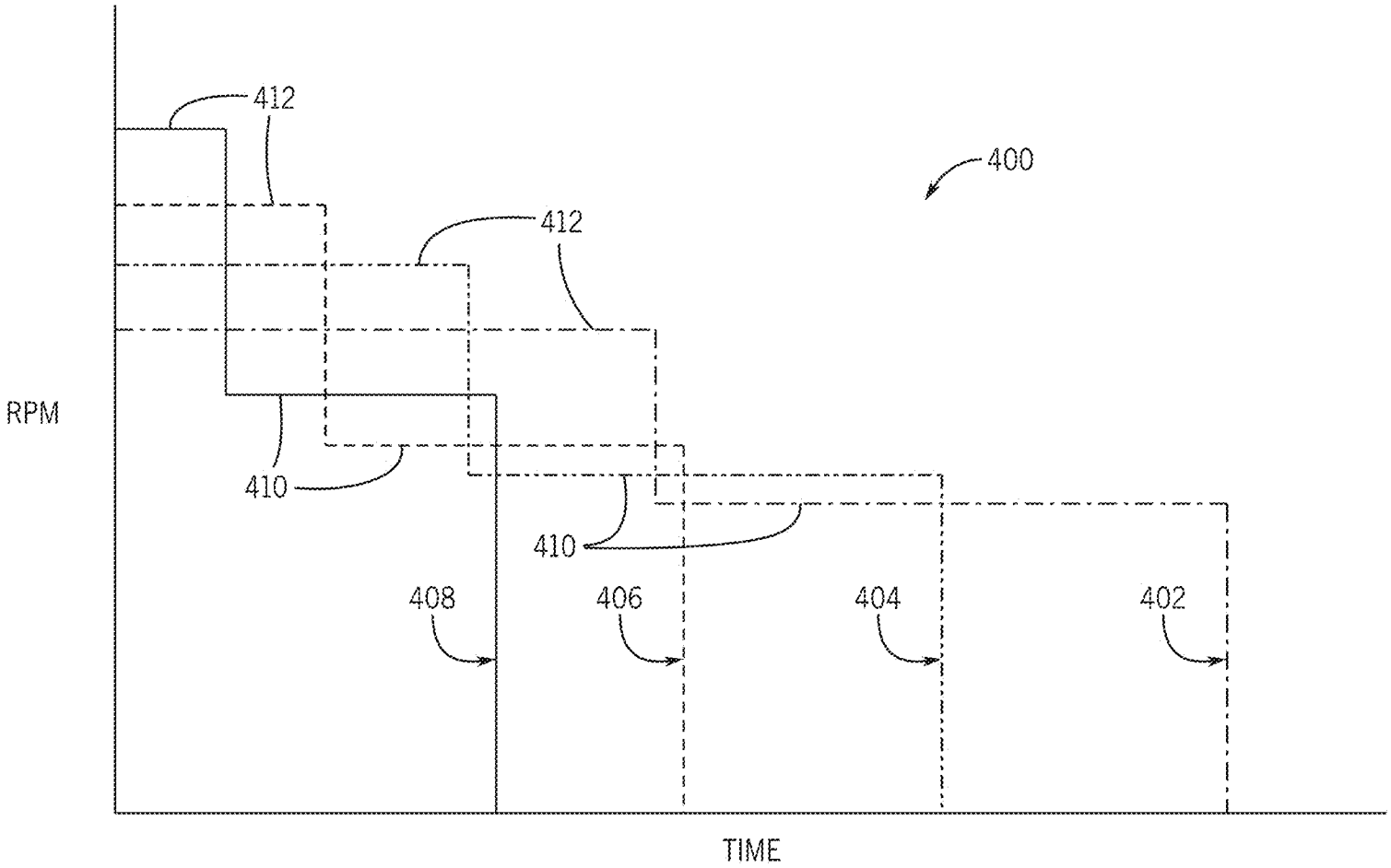
FIG. 4 is a graph illustrating various pump speed profiles for the hydraulic system under various system conditions.

FIG. 4 shows a graph 400 illustrating the relationship between the speed in revolutions per minute (RPM) of the hydraulic pump 202 versus time for a plurality of speed profiles while lowering the fork assembly 108. For example, the first speed profile 402 may correspond to when the controller 218 has determined, as discussed above, that the hydraulic oil is not above a predetermined temperature threshold and that the payload on the fork assembly 108 is not above a predetermined weight threshold. The second speed profile 404 may correspond to when the controller 218 has determined that the hydraulic oil is not above the predetermined temperature threshold and that the payload on the fork assembly 108 is above the predetermined weight threshold. The third speed profile 406 may correspond to when the controller 218 has determined that the hydraulic oil is above the predetermined temperature threshold, and that the payload on the fork assembly 108 is not above the predetermined weight threshold. The fourth speed profile 408 may correspond to when the controller 218 has determined that the hydraulic oil is above the predetermined temperature, and that the payload on the fork assembly is above the predetermined weight threshold.

Each of the speed profiles 402, 404, 406, 408 may include a first pump speed 410 and a second pump speed 412. The first pump speed 410 may be a free lift operating state speed, which may correspond to when the controller 218 has determined that the fork assembly 108 is below the predetermined height threshold during a lowering event. The second pump speed 412 may be a main lift operating state speed, which may correspond to when the controller 218 has determined that the fork assembly is above the predetermined height threshold during a lowering event. The main lift operating state speed may be lower than the free lift operating speeds due to increased weight being lifted. Due to the weight of the elevating mast sections of the telescoping mast 104 during a main lift operating state in main lift, the pump may need to be run slower than when the elevating mast sections are not lifted in order to operate efficiently. It should be appreciated that, for each speed profile 402, 404, 406, 408, the controller 218 can be configured to switch between the first pump speed 410 and the second pump speed 412 based on the measured height of the fork assembly 108, as described above. It should be appreciated that in operation the controller 218 may control the pump speed to be with a predefined tolerance of a target pump speed (e.g., one of the first pump speed 410 or the second pump speed 412 for a given speed profile). In addition, the controller 218 may be configured to operate the hydraulic pump 202 with a predetermined set of speed profiles during a lift event.

Higher temperatures of the hydraulic oil can indicate lower viscosity of the hydraulic oil, which allows the pump to operate efficiently at higher speeds. In other words, speed profiles corresponding to higher temperatures, i.e. the fourth speed profile 408, have first and second pump speeds that are higher than first and second pump speeds of speed profiles corresponding to lower temperatures, i.e. the second speed profile 404.

Figure 5:
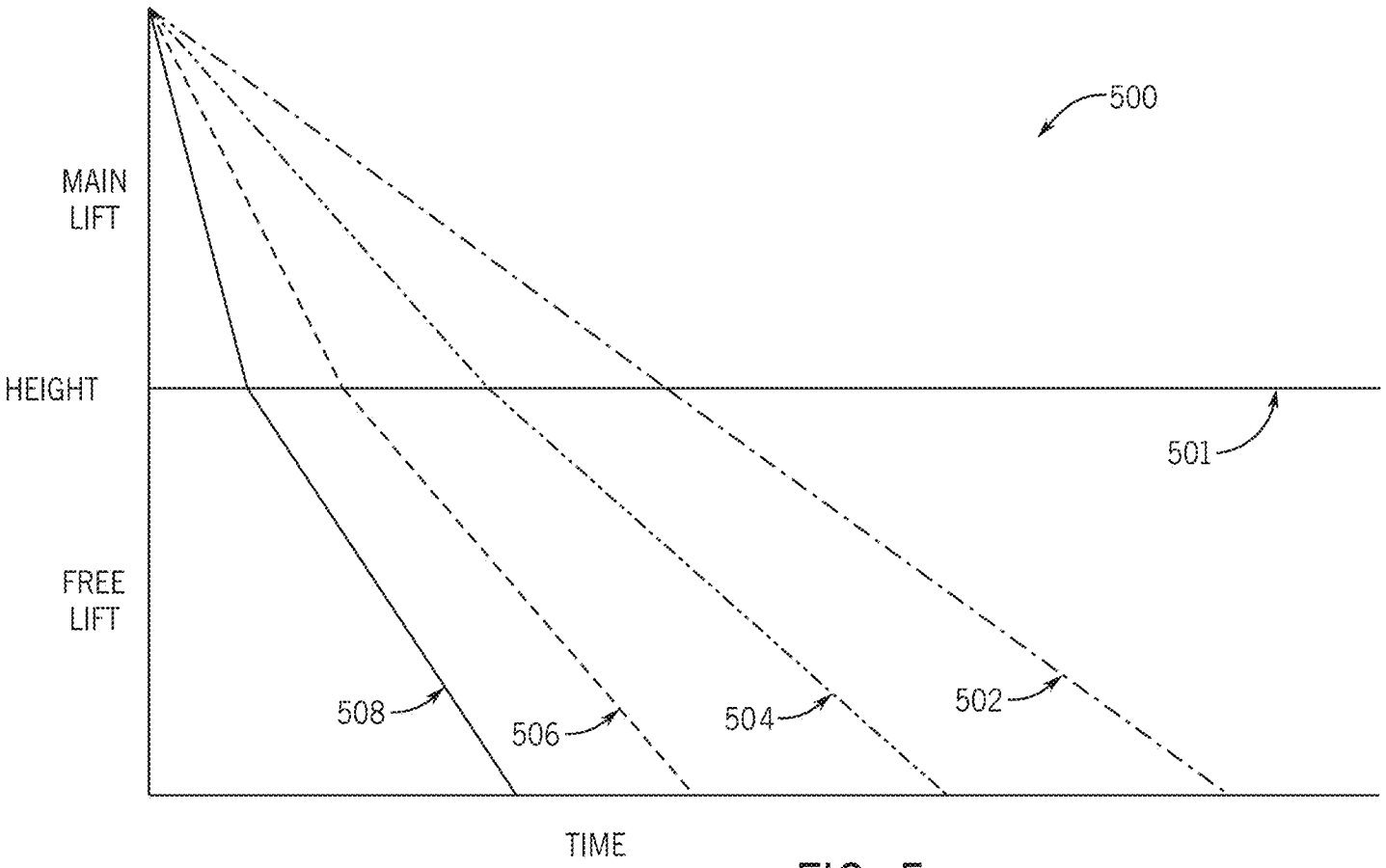
FIG. 5 is a graph illustrating various lower position profiles as a function of time for the hydraulic system under various system conditions.

FIG. 5 shows a graph 500 illustrating a corresponding relationship between the height of the fork assembly 108 versus time for a plurality of position profiles while lowering the fork assembly 108 from above a predetermined height threshold 501 to below the predetermined height threshold 501. The position profiles illustrated in FIG. 5 represent a desired lowering speed for the fork assembly 108 (i.e., the slop of the position profiles, height vs. time, equates to velocity), and the various speed profiles illustrated in FIG. 4 may be correlated with a given position profile. For example, the first position profile 502 may correspond to the first speed profile 402. The second position profile 504 may correspond to the second speed profile 404. The third position profile 506 may correspond to the third speed profile 406. The fourth position profile 508 may correspond to the fourth speed profile 408.

The fork assembly 108 can be efficiently lowered faster when in the main lift operating state than in the free lift operating state, regardless of the temperature of the hydraulic oil. This is illustrated by the steeper slope of the position profiles in the main lift portion compared to the free lift portion. However, as will be described herein, the opposite may be true for a lifting operation. Due to the weight of the elevating mast sections of the telescoping mast 104 during a main lift operating state main lift, there is a higher effective weight on the system during the main lift operating state, as compared to the free lift operating state. The back pressure in the hydraulic system 200 may be increased during the main lift operating state, which may allow for the fork assembly 108 to be lowered at a higher speed. The speed profiles may have a first lowering speed corresponding to the free lift operating state that is smaller than a second lowering speed corresponding to the main lift operating state, which is represented by the step change on the speed profiles 402, 404, 406, and 408 in FIG. 4.

Figure 6:
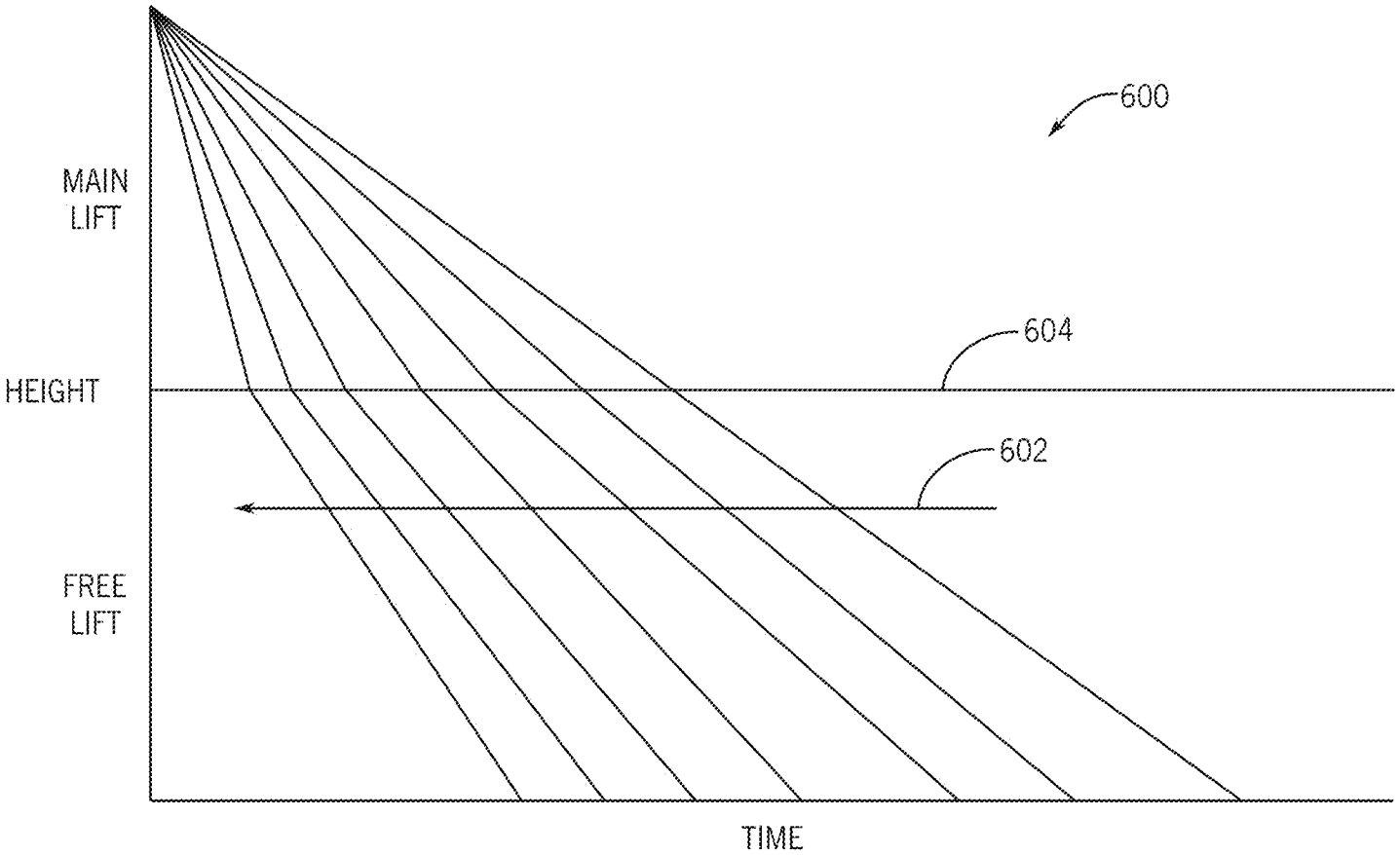
FIG. 6 is a graph illustrating various lower position profiles as a function of time for the hydraulic system under various system conditions including the effect of viscosity on lowering speed.

FIG. 6 shows a graph 600 illustrating a corresponding relationship between the height of the fork assembly 108 versus time for a plurality of position profiles with varying oil viscosity conditions. Arrow 602 indicates a direction of decreasing oil viscosities. A height threshold 604 shows the cutoff between the main lift operating state and the free lift operating state, with the main lift operating state corresponding to heights above the height threshold 604 and heights below the height threshold corresponding to the free lift operating state. As illustrated, as oil viscosity decreases, the speed at which the fork assembly 108 can be efficiently lowered may increase as indicated by the steeper slopes defined by the position profiles. Higher temperatures of the hydraulic oil can indicate that the oil viscosity has decreased. Upon sensing higher temperatures, the controller 218 may cause the fork assembly 108 to be lowered efficiently at a higher speed as compared to a lower temperature. As illustrated in FIG. 4, the speed profiles may have a first lowering speed corresponding to the free lift operating state and a second lowering speed corresponding to the main lift operating state. The first lowering speed and the second lowering speed of speed profiles corresponding to higher hydraulic oil temperatures may be larger than the first lowering speed and the second lowering speed of speed profiles corresponding to lower hydraulic oil temperatures. For example, the speed profiles transitioning from 402 to 408 may be indicative of increased pump speeds used for decreasing viscosity to match the desired position profiles in FIG. 6 (i.e., a given pump speed may be used to match a desired lowering velocity of the fork assembly 108).

Figure 7:
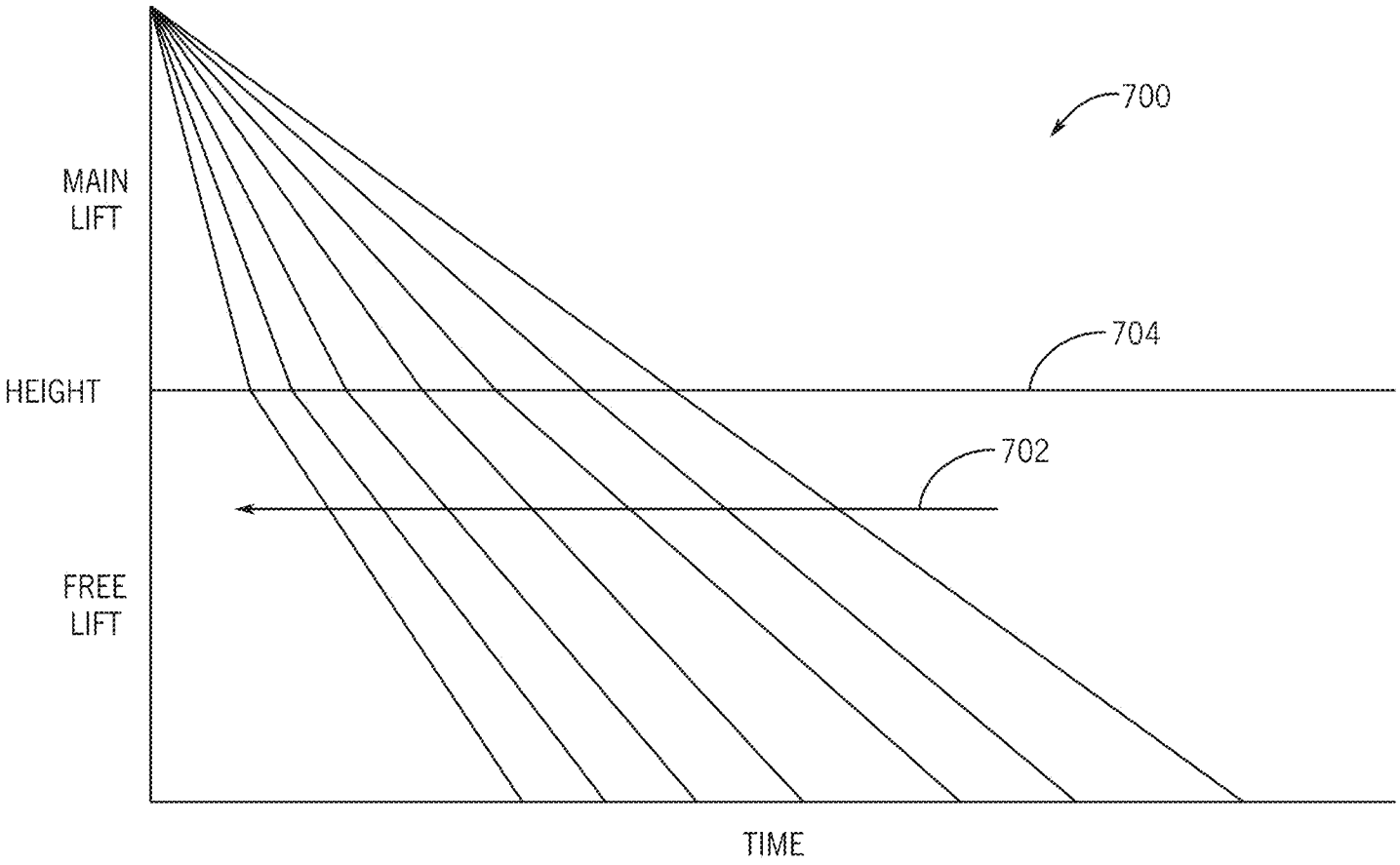
FIG. 7 is a graph illustrating various lower position profiles as a function of time for the hydraulic system under various system conditions including the effect of payload weight on lowering speed.

FIG. 7 shows a graph 700 illustrated a corresponding relationship between the height of the fork assembly 108 versus time for a plurality of position profiles for varying payloads on the fork assembly 108. Arrow 702 indicates a direction of increasing payload weight. A height threshold 704 shows the cutoff between the main lift operating state and the free lift operating state, with the main lift operating state corresponding to heights above the height threshold 704 and heights below the height threshold corresponding to the free lift operating state. As illustrated, as payload increases, the speed at which the fork assembly 108 can be efficiently lowered may increase as indicated by the steeper slopes defined by the position profiles. A higher payload can cause a higher back pressure in the hydraulic system 200, which may allow for the fork assembly 108 to be lowered efficiently at a higher speed as compared to a lower payload. Speed profiles may have a first lowering speed corresponding to the free lift operating state and a second lowering speed corresponding to the main lift operating state. The first lowering speed and the second lowering speed of speed profiles corresponding to heavier payloads may be faster than the first lowering speed and the second lowering speed of speed profiles corresponding to lighter payloads.

Figure 8:
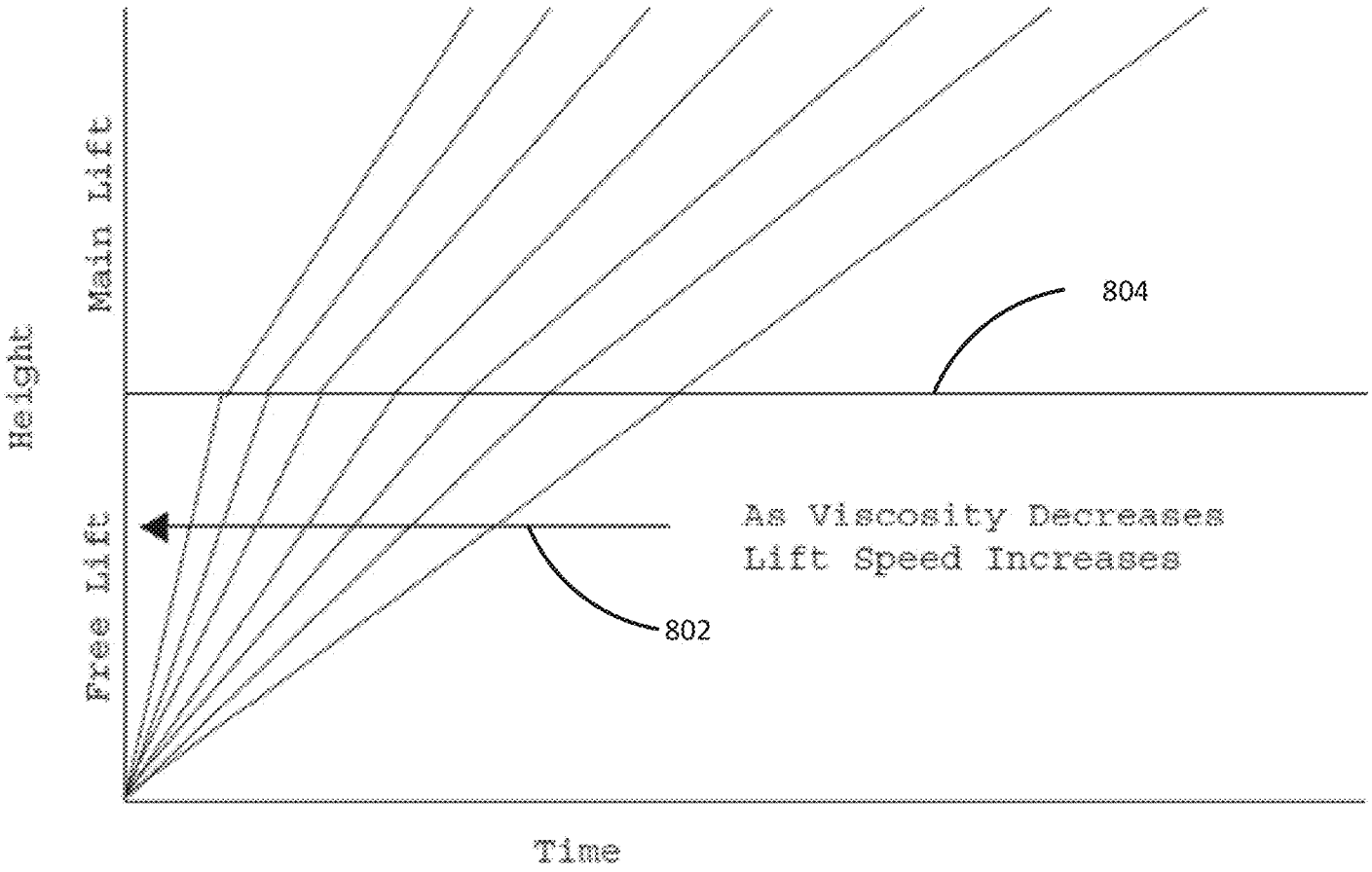
FIG. 8 is a graph illustrating various lifting position profiles as a function of time for the hydraulic system under various system conditions including the effect of viscosity on lifting speed.

While the provided examples are illustrating a lowering operation, the pump speed may be controlled efficiently as a function of one or more of fork height, viscosity, and payload weight. For example, FIG. 8 illustrates an example of position profiles (i.e., height of the fork assembly 108 as a function of time) for a lifting operation with varying oil viscosity. Arrow 802 indicated a direction of decreasing oil viscosity. A height threshold 804 shows the cutoff between the main lift operating state and the free lift operating state, with the main lift operating state corresponding to heights above the height threshold 804 and heights below the height threshold corresponding to the free lift operating state. As illustrated in FIG. 8, for lifting operations, the speeds corresponding with the free lift state are higher than the speeds associated with the main lift state, which is illustrated by the steeper slopes defined in the free lift portion compared to the main lift portion.

Figure 9:
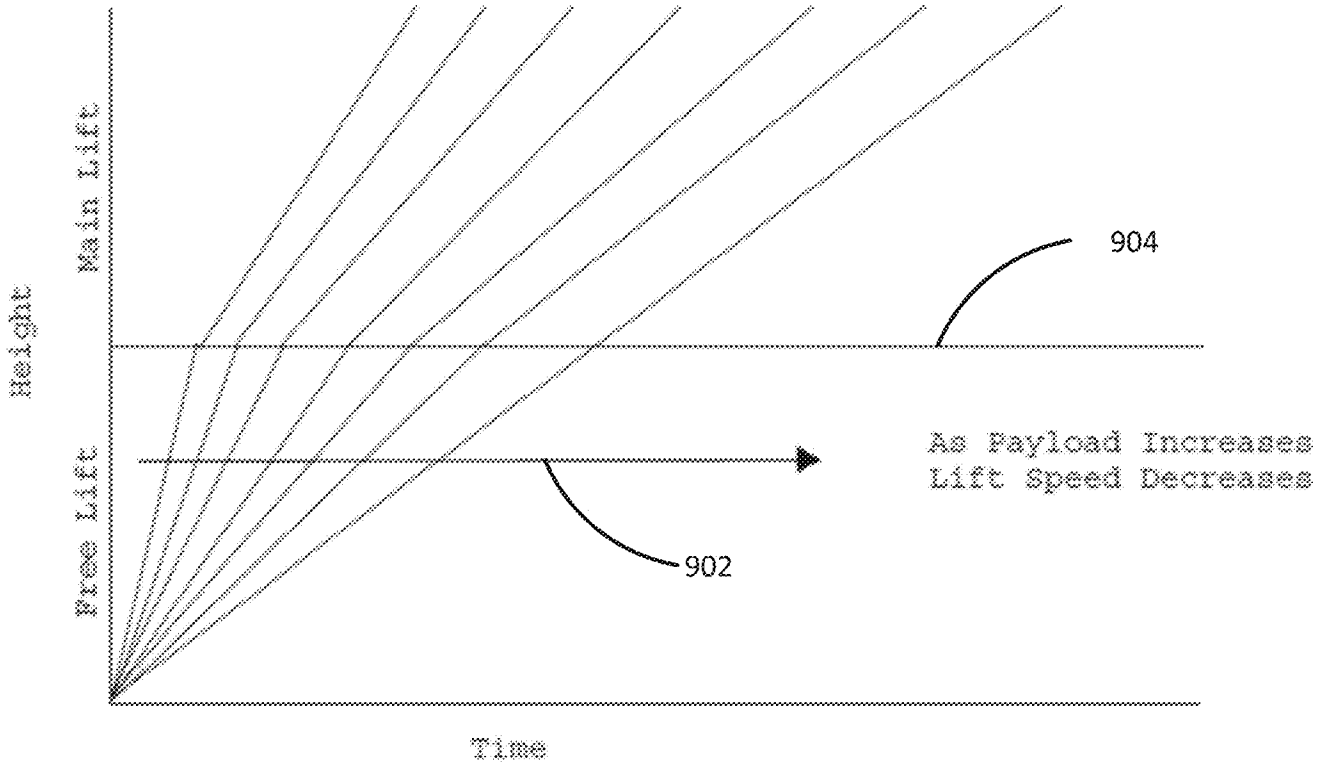
FIG. 9 is a graph illustrating various lifting position profiles as a function of time for the hydraulic system under various system conditions including the effect of payload on lifting speed.
Figure 10:
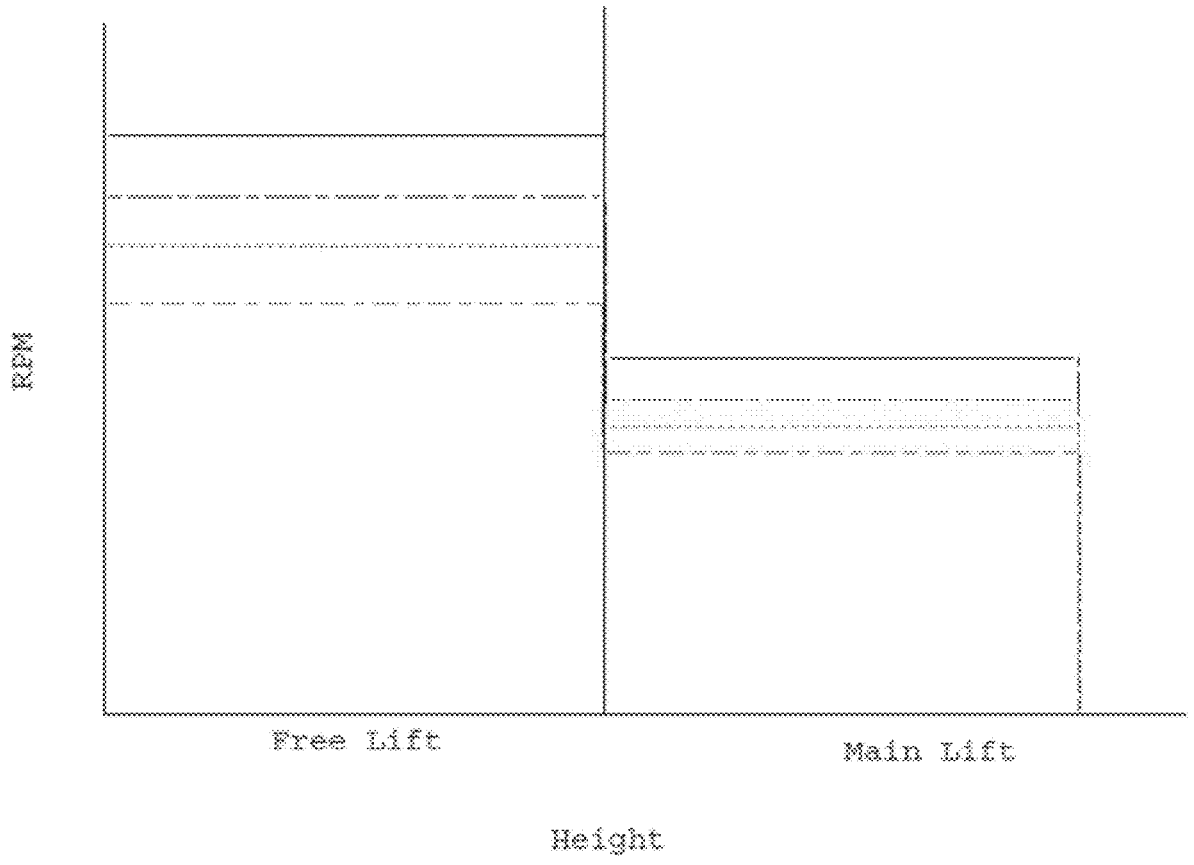
FIG. 10 is a graph illustrating various pump speed profiles as a function of fork height for auxiliary functions.

FIG. 8 also illustrates that as oil viscosity decreases the fork assembly 108 may be lifted at a higher speed. Regarding payload, an opposite relationship may be true as illustrated in FIG. 9, with arrow 902 illustrating increasing payload. As illustrating in FIG. 9, when the fork assembly 108 is lifting less payload, there may be less back pressure in the hydraulic system 200, which may allow for the fork assembly 108 to be lifted at a higher speed. This same principle may apply to the main lift operating state versus the free lift operating state, as there is a higher effective weight on the system during the main lift operating state, as compared to the free lift operating state, due to the added weight of the elevated mast sections of the telescoping mast. A similar rationale may apply to an auxiliary reach operation. For example, FIG. 10 illustrates a plurality of pump speed profiles as a function of height. As illustrated in FIG. 10, the speed profiles associated with the free light portion have a higher magnitude than the main lift portion. In some non-limiting examples, the highest magnitude speed profile (i.e., the top profile from the perspective of FIG. 10) may corresponding with a decreased viscosity and/or a decreased payload on the fork assembly 108 and the decreasing magnitude of the other speed profiles may represent conditions with increased viscosity and/or increased payload. Similar to FIG. 4, in operation the controller 218 may control the pump speed to be within a predefined tolerance of the speed profiles illustrated in FIG. 10.

While the methods described above include single threshold values for each of the fork height, the oil temperature, and the payload, the controller 218 may be configured to determine an efficient speed for the hydraulic pump 202 for any number of fork assembly heights, oil temperatures, and payload weights. For example, the controller 218 may be configured to reference a predetermined lookup chart having inputs of fork assembly height, oil temperature, and payload weight when determining an optimal speed of the hydraulic pump 202.

Figure 11:
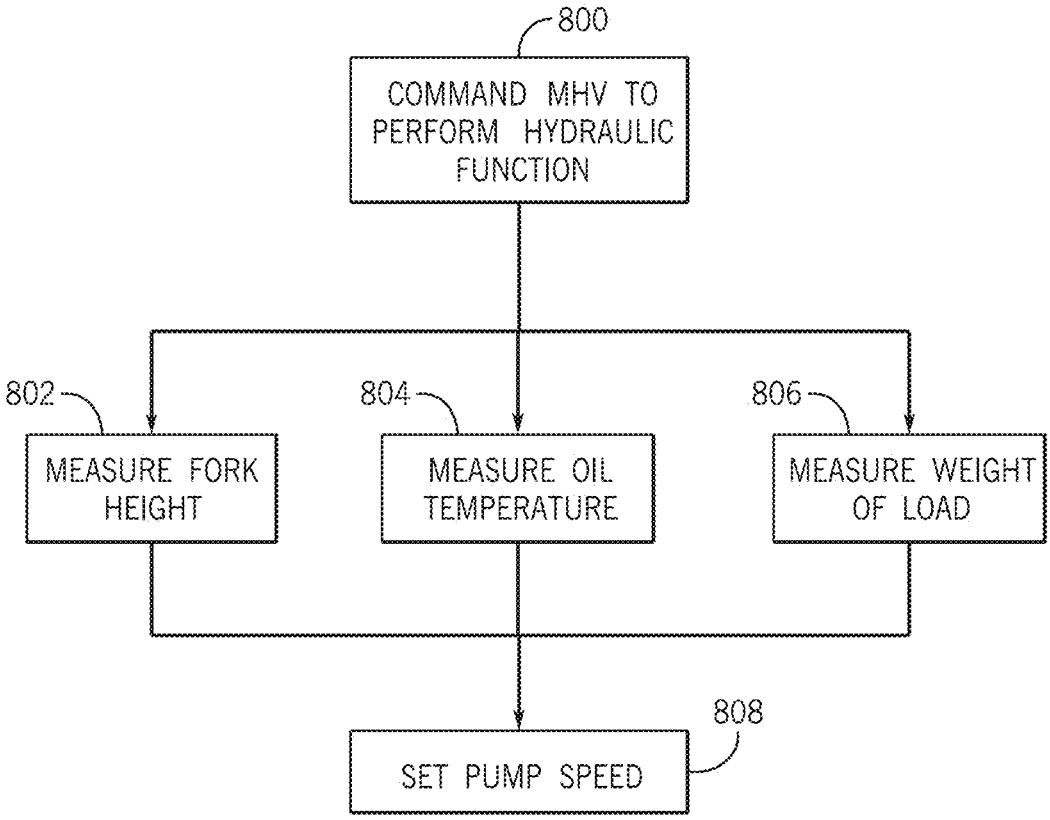
FIG. 11 is a flowchart showing a method of operating the hydraulic pump of the hydraulic system of FIG. 2.

For example, FIG. 11 illustrates another non-limiting example of exemplary steps for setting a speed of the hydraulic pump 202 while using the hydraulic system 200 of FIG. 2. During operation, a user can command, at step 800, the MHV 100 to perform a hydraulic function, such as, for example, raising, lowering, reaching, or retracting the fork assembly 108 or any other desired hydraulic function. Once the user commands the MHV 100 to perform the hydraulic function, the controller 218 can measure, at step 802, the height of the fork assembly 108 using the height sensor 216. Before, during, or after measuring the height of the fork assembly 108, at step 802, the controller 218 can measure, at step 804, the temperature of the hydraulic oil within the hydraulic system 200 using the temperature sensor 212. Before, during, or after measuring the height of the fork assembly 108, at step 802, and measuring the temperature of the hydraulic oil, at step 804, the controller 218 can measure, at step 806, the weight of the payload using the weight sensor 214. Once each of the height of the fork assembly 108, the temperature of the hydraulic oil, and the weight of the payload have been measured, the controller 218 may then set a speed of the hydraulic pump 202 corresponding to a predetermined speed based on the measured system conditions.

In some aspects, when the MHV is on, the elevated height of the fork assembly 108 may be continuously monitored. At the time of a hydraulic function request, such as a lift or lower request, the elevated height of the fork assembly may be checked and a predetermined RPM for that condition may be used to drive the motor and pump at an efficient RPM.

In some aspects, when the MHV is on, both oil temperature and the elevated height of the fork assembly 108 may be continuously monitored. At the time of a hydraulic function request, such as a lift or lower request, the oil temperature and the elevated height of the fork assembly may be measured and a predetermined RPM for the measured conditions may be used to drive the motor and pump at an efficient RPM.

In some aspects, when the MHV is on, oil temperature, elevated height of the fork assembly, and payload may be continuously monitored. At the time of a hydraulic function request, such as a lift or lower request, the oil temperature, the elevated height of the fork assembly 108, and the weight of the payload may be measured, and a predetermined RPM for the three measured conditions may be used to drive the motor and pump at an efficient RPM.

It should be appreciated that any of the oil temperature, the elevated height of the fork assembly, and the weight of the payload on the fork assembly may be measured and used individually to determine an efficient hydraulic pump RPM. Likewise, any combination of these three monitored conditions may be used to determine an efficient hydraulic pump RPM.

In some aspects, the speed of auxiliary hydraulic functions performed on the forks may use the same or similar rationales to those discussed above regarding main lift and free lift functions. For example, the same conditions may be monitored in the same manner to similarly drive vehicle efficiency and performance. However, for auxiliary functions, such as, for example, performing a reach function on a reach truck, the load handling function at height may be adjusted to minimizing mast sway and optimize time to perform a pick up or put away operation.

Figure 12:
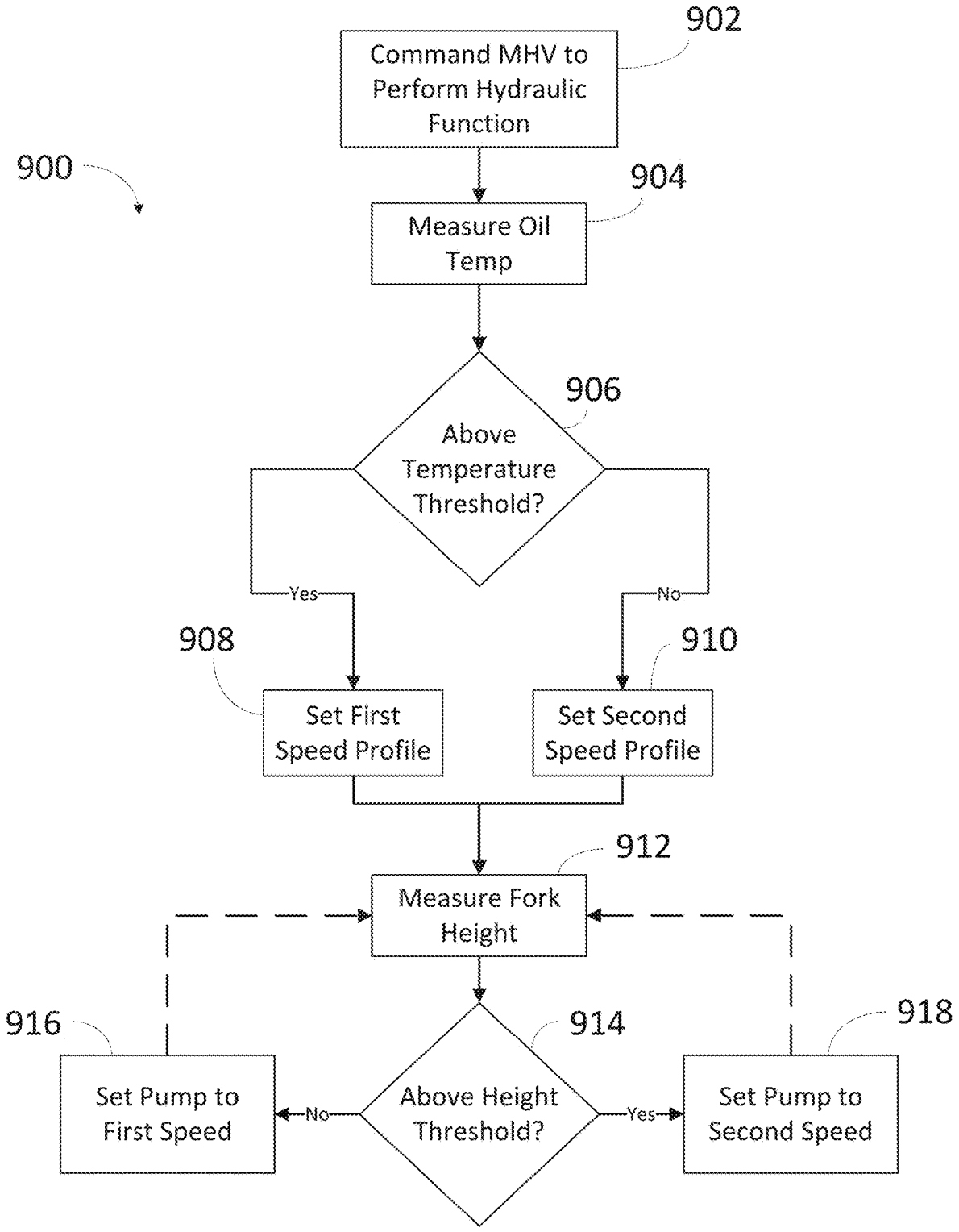
FIG. 12 is a flow chart showing a method of operating the hydraulic pump of the hydraulic system of FIG. 2 based on oil temperature and fork height.

FIG. 12 shows an exemplary process 900 for setting a speed of the hydraulic pump 202 while using the hydraulic system 200 of FIG. 2. The process may be implemented as instructions on a memory of the controller 218.

At 902, the process 900 can receive a command to cause the MHV to perform a hydraulic function. The command may be from another process such as automatic picking program within the controller 218 or another controller of the MHV, or from a human operator of the MGV.

At 904, the process can measure a temperature of a hydraulic fluid such as hydraulic oil within the hydraulic system 200 using the temperature sensor 212.

At 906, the process can determine if the temperature of the hydraulic fluid is above a predetermined temperature threshold. If the process determines that the temperature is above the temperature threshold, ("Yes" at 906), the process can proceed to 908. If the process determines that the temperature is not above the temperature threshold, ("No" at 906), the process can proceed to 910. In some embodiments, if the process determines that the temperature is above the temperature threshold, the process 900 may proceed to another decision block with a higher temperature threshold than the threshold of 906 in and determine if the temperature is higher or lower than the higher temperature threshold. In this way, a more accurate and/or specific speed profile may be chosen, as will be explained below. Similarly, if the process determines that the temperature is not above the temperature threshold, the process 900 may proceed to another decision block with a lower temperature threshold than the threshold of 906 in and determine if the temperature is higher or lower than the lower temperature threshold.

At 908, the process 900 can set a first speed profile. The first speed profile is selected based on the temperature of the hydraulic fluid. The first speed profile can have a first pump speed, a second pump speed, a first lowering speed, and a second lowering speed. The first pump speed can be a free lift operating state speed and the second pump speed can be a main lift operating state speed. Comparing the temperature to one or more temperature thresholds can allow the hydraulic system 200 to raise and/or lower the fork assembly 108 and/or a load more efficiently. When the temperature of the hydraulic fluid is known, the viscosity of the fluid can be estimated as described above, and the hydraulic system 200 and/or pump 202 can be run at setting optimal to the viscosity. The first The process can then proceed to 912.

At 910, the process 900 can set a second speed profile. The second speed profile is selected based on the temperature of the hydraulic fluid. The second speed profile can have a first pump speed, a second pump speed, a first lowering speed, and a second lowering speed. The first pump speed can be a free lift operating state speed and the second pump speed can be a main lift operating state speed. The first pump speed, the second pump speed, the first lowering speed, and the second lowering speed of the second speed profile may all be lower than the first pump speed, the second pump speed, the first lowering speed, and the second lowering speed of the first speed profile, respectively. The second profile corresponds to a lower viscosity of the hydraulic fluid than the first speed profile. The process can then proceed to 912.

At 912, the process 900 can measure the height of the fork assembly 108 using the height sensor 216. The process 900 can then proceed to 914.

At 914, the process 900 can determine, if the fork assembly 108 is above a predetermined height threshold. The predetermined height threshold may correspond to a height where the MHV 100 switches from a free lift operating state (i.e., where the fork assembly 108 is being raised and lowered using the free lift cylinder 205), when the fork assembly 108 is below the predetermined height threshold, to a main lift operating state (i.e., where the fork assembly 108 is being raised and lowered using the main lift cylinder 204), when the fork assembly 108 is above the predetermined height threshold. The process 900 may then select a lift state, i.e. the free lift operating state or the main lift operating state, based on the measured height. The selected lift state can be associated with the first pump speed if the selected lift state is the free lift operating state, or associated with the second speed if the selected lift state is the main lift operating state. Measured heights above the height threshold may indicate a relatively high payload weight on the fork assembly 108, while values not above the height threshold may indicate a relatively low payload weight on the fork assembly 108. If the process 900 determines that the fork assembly 108 is not above the predetermined height threshold ("No" at 914), the process 900 may proceed to 916. If the process 900 determines that the fork assembly 108 is above the predetermined height threshold ("Yes" at 914), the process 900 may proceed to 918.

At 916, the process 900 can control a pump speed of a hydraulic pump on the material handling vehicle to operate within a predefined tolerance of a target pump speed. The target pump speed can be selected to be the first pump speed of the selected speed profile, which may be higher than the second pump speed of the selected speed profile. The first pump speed may be a free lift operating state speed, which may correspond to when the process 900 has determined that the fork assembly 108 is below the predetermined height threshold. The second pump speed may be a main lift operating state speed, which may correspond to when the process 900 has determined that the fork assembly 108 is above the predetermined height threshold. The process 900 can then proceed to 912 in order to continue measuring the height of the fork assembly 108, such that the process 900 may intermittently or continuously monitor the height of the fork assembly 108. With the controller intermittently or continuously monitoring the height of the fork assembly 108, if the fork assembly 108 drops below or rises above the predetermined height threshold, the controller 218 can switch the hydraulic pump 202 from the first pump speed to the second pump speed, or vice versa. It is to be appreciated that there may be several different height ranges and several different associated speed settings.

At 918, the process 900 can control a pump speed of a hydraulic pump on the material handling vehicle to operate within a predefined tolerance of a target pump speed. The target pump speed can be selected to be the second pump speed of the selected speed profile, which may be lower than the first pump speed of the selected speed profile. The process 900 can then proceed to 912 in order to continue measuring the height of the fork assembly 108, such that the process 900 may intermittently or continuously monitor the height of the fork assembly 108. Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

I claim:

1. A method for controlling pump speed in a hydraulic system on a material handling vehicle, the method comprising:

measuring a temperature, via a temperature sensor, of hydraulic fluid during operation of the material handling vehicle;

measuring a height, via a height sensor, of a fork assembly on the material handling vehicle;

determining a target pump speed based on the measured temperature of the hydraulic fluid and the measured height of the fork assembly; and controlling a pump speed of a hydraulic pump on the material handling vehicle to operate within a predefined tolerance of the target pump speed.

2. The method of claim 1 further comprising measuring a weight of a load using a weight sensor, and wherein the target pump speed is further determined based on the measured weight.

3. The method of claim 1 further comprising selecting a speed profile from a plurality of speed profiles based on the measured temperature.

4. The method of claim 3 further comprising determining that the measured temperature is above a temperature threshold, and wherein each speed profile has a free lift operating state speed and a main lift operating state speed and the free lift operating state speed and the main lift operating state speed of selected speed profile are greater than the free lift operating state speed and the main lift operating state speed of at least one other speed profile.

5. The method of claim 3 further comprising selecting the target pump speed based on the selected speed profile and a lift state of the fork assembly.

6. The method of claim 5 further comprising:

determining the measured height is above a height threshold; and selecting the lift state from a plurality of lift states comprising a main lift operating state and a free lift operating state, wherein the selected lift state is the main lift operating state.

7. The method of claim 6, wherein the selected speed profile has a free lift operating state speed and a main lift operating state speed, the free lift operating state speed being less than the main lift operating state speed, and the method further comprises setting the target pump speed to be the main lift operating state speed.

8. The method of claim 5 further comprising:

determining the measured height is not above a height threshold; and selecting the lift state from a plurality of lift states comprising a main lift operating state and a free lift operating state, wherein the selected lift state is the free lift operating state.

9. The method of claim 8, wherein the selected speed profile has a free lift operating state speed and a main lift operating state speed, the free lift operating state speed being greater than the main lift operating state speed, and the method further comprises setting the target pump speed to be the main lift operating state speed.

10. The method of claim 3, wherein each speed profile has a first pump speed and a second pump speed, the first pump speed being greater than the second pump speed, and the method further comprises:

determining that the measured height is above a height threshold; and setting the target pump speed to be equal to the second pump speed of the selected speed profile.

11. A material handling vehicle comprising:

a fork assembly;

a hydraulic system including:

a hydraulic pump configured furnish hydraulic fluid to the fork assembly to selectively operate the fork assembly with the hydraulic system; and a temperature sensor configured to measure a temperature of the hydraulic fluid within the hydraulic system;

a height sensor configured to measure a height of the fork assembly;

a controller in communication with the temperature sensor and the height sensor, the controller being configured to:

receive a temperature value from the temperature sensor;

receive a height value from the height sensor;

determine a target pump speed based on the temperature value and the height value; and control the hydraulic pump to operate within a predefined tolerance of the target pump speed.

12. The material handling vehicle of claim 11, wherein the controller is further configured to measure a weight of a load using a weight sensor, and wherein the target pump speed is further determined based on the measured weight.

13. The material handling vehicle of claim 11, wherein the controller is further configured to select a speed profile from a plurality of speed profiles based on the received temperature value.

14. The material handling vehicle of claim 13, wherein the controller is further configured to determine that the received temperature value is above a temperature threshold, and wherein each speed profile has a free lift operating state speed and a main lift operating state speed, and the free lift operating state speed and the main lift operating state speed of selected speed profile are greater than the free lift operating state speed and the main lift operating state speed of at least one other speed profile.

15. The material handling vehicle of claim 13, wherein the controller is further configured to select the target pump speed based on the selected speed profile and a lift state of the fork assembly.

16. The material handling vehicle of claim 15, wherein the controller is further configured to:

determine the received height value is above a height threshold; and select the lift state from a plurality of lift states comprising a main lift operating state and a free lift operating state, wherein the selected lift state is the main lift operating state.

17. The material handling vehicle of claim 16, wherein the selected speed profile has a free lift operating state speed and a main lift operating state speed, the free lift operating state speed being less than the main lift operating state speed, and the controller is further configured to set the target pump speed to be the main lift operating state speed.

18. The material handling vehicle of claim 15, wherein the controller is further configured to:

determine the received height value is not above a height threshold; and select the lift state from a plurality of lift states comprising a main lift operating state and a free lift operating state, wherein the selected lift state is the free lift operating state.

19. The material handling vehicle of claim 18, wherein the selected speed profile has a free lift operating state speed and a main lift operating state speed, the free lift operating state speed being greater than the main lift operating state speed, and the controller is further configured to set the target pump speed to be the main lift operating state speed.

20. The material handling vehicle of claim 13, wherein each speed profile has a first pump speed and a second pump speed, the first pump speed being greater than the second pump speed, and the controller is further configured to:

determine that the received height value is above a height threshold; and set the target pump speed to be equal to the second pump speed of the selected speed profile.

* * * * *